United States Patent [19]

Trimble

[11] 4,248,254

[45] Feb. 3, 1981

[54] RETAINER FOR TOILET ARTICLES

[76] Inventor: Ronald L. Trimble, 210 E. Warren St., Williamsport, Ind. 47993

[21] Appl. No.: 938,081

[22] Filed: Aug. 30, 1978

[51] Int. Cl.[3] ..... A45D 44/18

[52] U.S. Cl. ..... 132/84 D

[58] Field of Search ..... 132/84, 92

[56] References Cited

U.S. PATENT DOCUMENTS

| | | | |
|---|---|---|---|
| 728,823 | 5/1903 | Adams | 242/85 |
| 949,587 | 2/1910 | Ludington | 132/84 B |
| 1,139,134 | 5/1915 | Miller | 132/84 D |
| 1,205,311 | 11/1916 | Wybaillie | 132/84 D |
| 1,475,789 | 11/1923 | Buckloy | 132/84 A |
| 1,711,327 | 4/1929 | Rock | 132/84 D |
| 1,840,433 | 1/1932 | Case | 132/84 D |
| 2,554,526 | 5/1951 | Dembenski | 132/92 R |
| 3,830,247 | 8/1974 | Kaphalakos | 132/90 |
| 3,847,167 | 11/1974 | Brien | 132/92 R |
| 4,162,688 | 7/1979 | Tarrson | 132/92 A |

*Primary Examiner*—G. E. McNeill

*Attorney, Agent, or Firm*—Gust, Irish, Jeffers & Hoffman

[57] ABSTRACT

A retainer for toilet articles or the like includes a housing having front, back and side walls mutually defining a cavity, the back housing wall being adapted for mounting on a vertical building wall, and the front wall having at least two horizontally-spaced openings therein communicating with the cavity. A plurality of reel devices each having an elongated, flexible element wound thereon are mounted in the cavity, the flexible elements respectively extending outwardly through the front wall openings and having means thereon for securing toilet articles thereto. The reel devices are adapted to pay-out and reel-in the flexible elements, respectively, so that each flexible element may be payed-out responsive to application of manual pulling force on the respective toilet article so as to permit use thereof, and thereafter reeled-in so as to suspend the article from the housing front wall in a storage position.

11 Claims, 8 Drawing Figures

2
40
30
40
38
32
68
16
26
10
54
54
74
22
56
56
60
60
20
RON
DONNA
BERT
CHRIS
66
18
28
62
62
14
36
48
34
48
2

64
40
30
32
68
16
44
26
58
10
54
14
56
60
12
74
24
38
18
62
50
20
36
42
52
46
34

RETAINER FOR TOILET ARTICLES

BACKGROUND OF THE INVENTION

1. Field of the Invention

This invention relates generally to retainers for toilet articles or the like, such as toothbrushes, hairbrushes and combs, and more particularly to a retainer for toilet articles in which each toilet article is permanently attached to the retainer in order to prevent loss or mislaying thereof.

2. Description of the Prior Art

Common toilet articles, such as toothbrushes, hairbrushes, combs, etc., are commonly stored in a medicine cabinet when not in use, and a wide variety of holders for removably suspending toothbrushes when not in use are also commonly employed; however, small children have a tendency to loose or misplace toilet articles, particularly toothbrushes. It is therefore desirable to provide a retainer for toilet articles or the like wherein the toilet articles are permanently secured thereto in order to prevent loss or misplacing thereof.

SUMMARY OF THE INVENTION

The invention, in its broader aspects, provides a retainer for toilet articles or the like which comprises a housing having front, back and side walls mutually defining a cavity, the back housing wall being adapted for mounting on a vertical building wall and the front wall having at least one opening therein communicating with the cavity. At least one reel device is provided mounted in the cavity and having an elongated flexible element wound thereon, the flexible element extending outwardly through the front wall opening and having means thereon for securing a toilet article thereto. The reel device is adapted to pay-out and reel-in a flexible element, respectively, whereby the flexible element may be payed-out responsive to application of manual withdrawing force on the toilet article to permit use thereof, and thereafter reeled-in to suspend the article from the housing front wall in a storage position.

It is accordingly an object of the invention to provide an improved retainer for toilet articles or the like.

Another object of the invention is to provide an improved retainer for toilet articles or the like wherein the article is permanently secured to the retainer to prevent loss or misplacing thereof.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
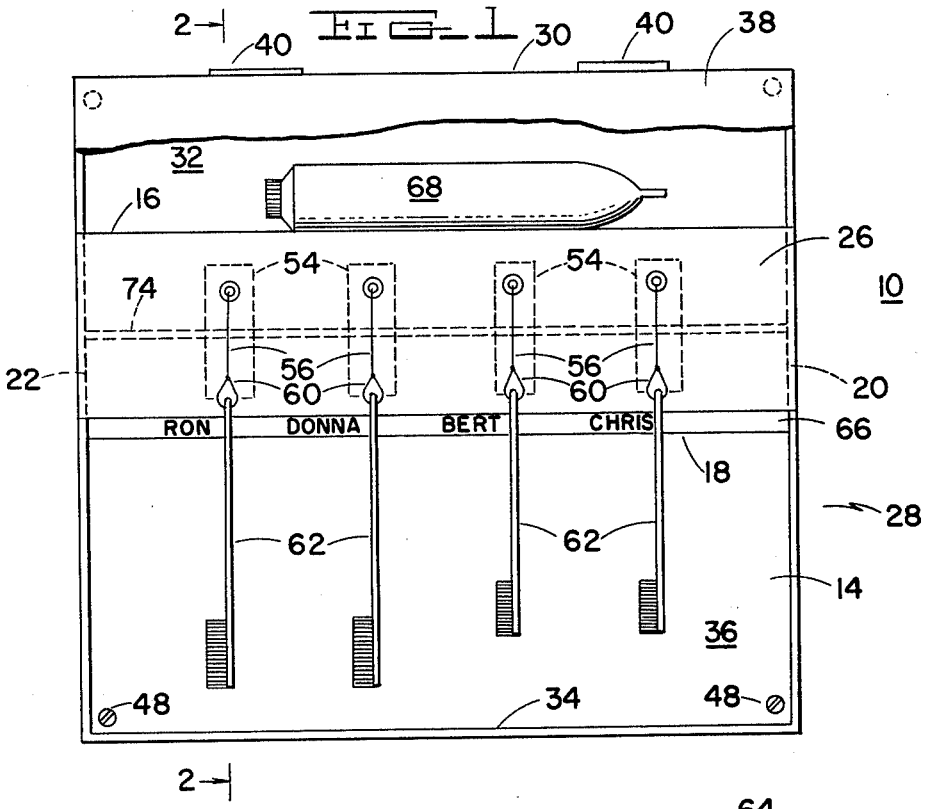
FIG. 1 is a front view, partly broken away, showing one embodiment of the invention employed for retaining toothbrushes.
Figure 2:
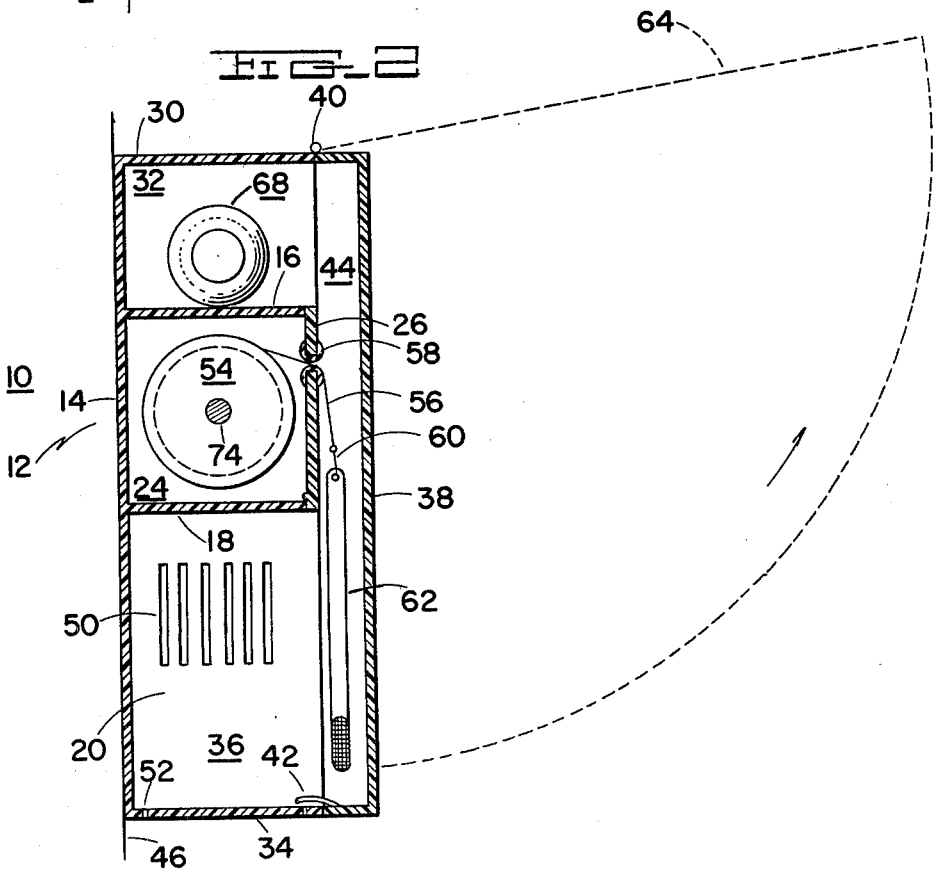
FIG. 2 is a side cross-sectional view taken generally along the line 2—2 of FIG. 1.

Referring now to FIGS. 1 and 2, an embodiment of the invention is shown, generally indicated at 10, adapted particularly for retaining toothbrushes, Retainer 10 comprises housing 12 having back wall 14, top and bottom walls 16, 18 and side walls, 20, 22 mutually defining cavity 24. Cover or front wall 26 removably closes cavity 24, as by a snap-in connection with walls 16, 18.

Housing 12 forms a part of larger housing 28 with back wall 14 and side walls 20, 22 being common to the two housings. Housing 28 includes top wall 30 defining cavity 32 with top wall 16 of housing 12, and bottom wall 34 defining cavity 36 with bottom wall 18 of housing 12. It will be seen that housings 12, 28 and walls 14, 16, 18, 20, 22, 30 and 34 thereof may be integrally molded of suitable plastic material.

Cover 38, which also may be molded of suitable plastic material, is hingedly connected to top wall 30, as at 40, and may have a snap-on latched connected with bottom wall 34, as at 42. Cover 38 in its closed position, as shown in FIG. 2, defines another cavity 44 with front wall 26 of housing 12 and which communicates with cavities 32, 36. Suitable openings may be formed in back wall 14 to secure housing 28 to vertical building wall 46, as by suitable screws 48. Suitable ventilating louvers 50 may be formed in side walls 20, 22 communicating with cavity 36 and suitable drain openings 52 may be formed in bottom wall 34.

One or more, shown here as being four, reel devices 54 are mounted in cavity 24 of housing 12. Each reel device 54 has cord 56 wound thereon and extending outwardly through suitable grommet 58 seated in an opening in front wall 26. Suitable snap-type clips 60 on cords 56 are connected to toothbrushes 62 which are thereby normally suspended in cavities 36, 44 in a storage position.

Cover 38 may be pivotally opened to its open position, as shown in dashed lines at 64, thereby to permit access to toothbrushes 62 for use. With cover 38 opened, toothbrushes 62 may be manually pulled-out thereby causing reel devices 54 to pay-out cord 56. Cords 56 remain attached to toothbrushes 62 by clips 60 during use. After use, reel devices 54 will reel-in cord 56, as hereinafter described, to return toothbrushes 62 to the storage position. With cords 56 thus remaining attached to toothbrushes 62, the tendency for children to mislay a toothbrush is prevented.

Strip 66 may be provided on front wall 26 upon which the names of individual toothbrush users may be marked, as with a felt tip pen. Cavity 32 may used for storing toothpaste tubes and the like, as at 68. Vents 50 communicating with lower cavity 36 provides for drying toothbrushes 62 in the storage position thereof when cover 38 is closed.

Figure 3:
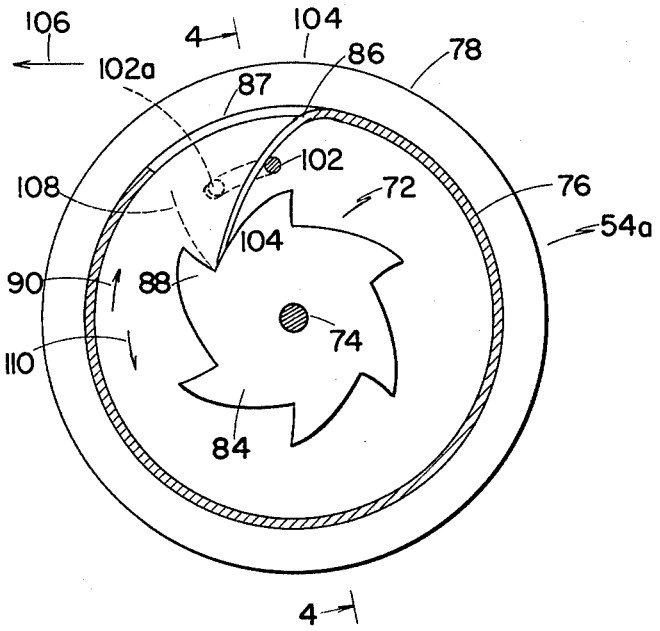
FIG. 3 is a fragmentary cross-sectional view showing one form of reel device usable in the invention.
Figure 4:
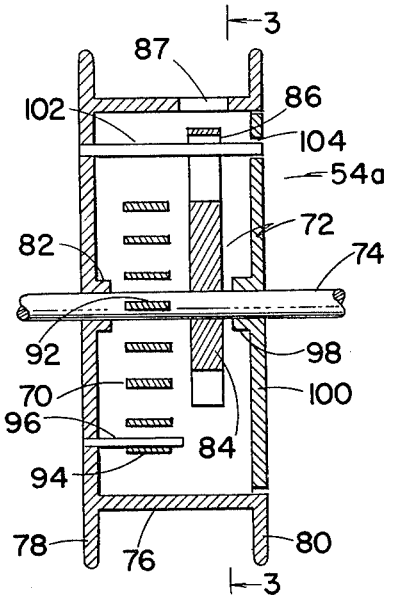
FIG. 4 is a cross-sectional view taken generally along the line 4—4 of FIG. 3.

Referring now to FIGS. 3 and 4, reel devices 54 of FIGS. 1 and 2 may be of the "window shade roller" type as shown at 54*a*, wherein paying-out of cord 56 winds-up coil spring 70 which thereafter causes reeling-in of cord 56, cord 56 being freely payed-out and reeled-in so long as tension is maintained thereon, but reeling-in under the influence of flat coil spring 70 is prevented by ratchet mechanism 72 whenever tension is removed from cord 56. Here, reel devices 54 are mounted on common, stationary shaft 74 mounted on and extending between side walls 20, 22.

Each reel device 54*a* includes drum 76 upon which cord 56 is wound between flanges 78, 80. Flange 78 is rotatably mounted on shaft 74 for rotation with respect thereto by hub portion 82. Ratchet mechanism 72 includes toothed ratchet wheel 84 fixedly secured to stationary shaft 74. Leaf spring 86 may be formed from drum 76, as at 87, and normally engages a tooth 88 of ratchet wheel 84 to prevent reeling-in of cord 56 in the direction shown by arrow 90. Spring 70 has its inner end 92 seated in a suitable slot in shaft 74 and its outer end 94 secured to flange 78, as by pin 96. Hub 98 of disc 100 has a friction fit with shaft 74 flange 78 has pin 102 connected thereto movable in slot 104 in disc 100. It will be seen that so long as tension is maintained on cord 56 in the direction shown by arrow 106, drum 76 and flange 78 will be rotated in direction 110 thereby causing relative rotation with respect to disc 100, which is restrained by the friction connection of hub 98 with shaft 94, thereby to move pin 102 in slot 104 to the position shown in dashed lines in 102*a*, thereby biasing leaf spring 86 away from a tooth 88 so as to permit rotation of drum 76 in either direction shown by arrow 106 or 110. However, as soon as tension is released from cord 56, pin 102 will be returned to the position shown in solid lines in FIG. 3 thereby permitting leaf spring 86 again to engage a tooth 88 of ratchet wheel 84 thereby to prevent rotation of drum 76 in the direction shown by arrow 90 and thus to prevent further reeling-in of cord 56. It will be understood that the reel device 54*a* shown in FIGS. 3 and 4 is not my invention and that other conventional forms of "window-shade roller" reel devices may be employed.

Figure 5:
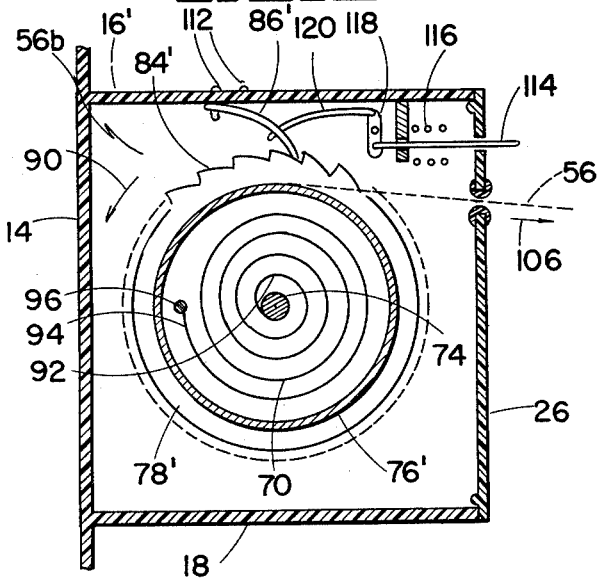
FIG. 5 is a fragmentary cross-sectional view showing another form of reel device usable in the invention.

Referring now to FIG. 5 in which like elements are indicated by like reference numerals and similar elements by primed reference numerals, reel device 56*b* has toothed ratchet wheel 84' formed on the outer periphery of flange 78' of drum 76'. Leaf spring 86' is secured to top wall 16 of housing 12, as by rivet 112. It will be seen that leaf spring 86' normally inhibits rotation of drum 76' in the direction shown by arrow 90, thus preventing reeling-in of cord 56. However, leaf spring 86' functions in the conventional ratchet fashion to permit paying-out of cord 56 in the direction shown by arrow 110. In order to release leaf spring 86' to permit reeling-in of cord 56, manually-actuated push-plunger 114 is provided acting against spring 116 which actuates pivoted level 118 so as to pull link 120 to move leaf spring 86' out of engagement with ratchet wheel 84'. It will be understood that reel device 56*b* shown in FIG. 5 likewise is not my invention and that other forms of button-release type of reel devices may be employed.

Figure 6:
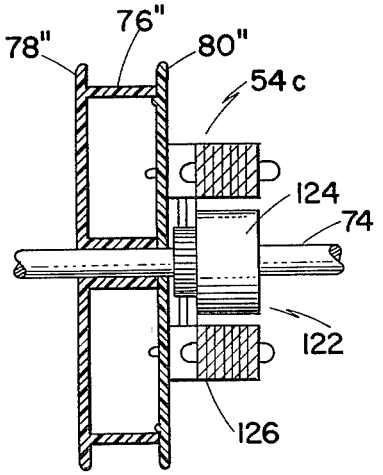
FIG. 6 is a fragmentary cross-sectional view showing yet another form of reel device usable in the invention.

Referring now to FIG. 6 in which like elements are again indicated by like reference numerals and similar elements by double primed reference numerals, reel device 54*c* is shown in which drum 76'' is driven to reel-in cord 56 by minature motor 122 having armature 124 secured to stationary shaft 74 and field 126 mounted on flange 80''. Motor 122 may be battery-powered with the batteries positioned either in cavity 32 or cavity 36 (FIGS. 1 and 2). A suitable push-button switch (not shown) is mounted on front wall 26 associated with each motor-driven reel device 54*c*.

Figure 7:
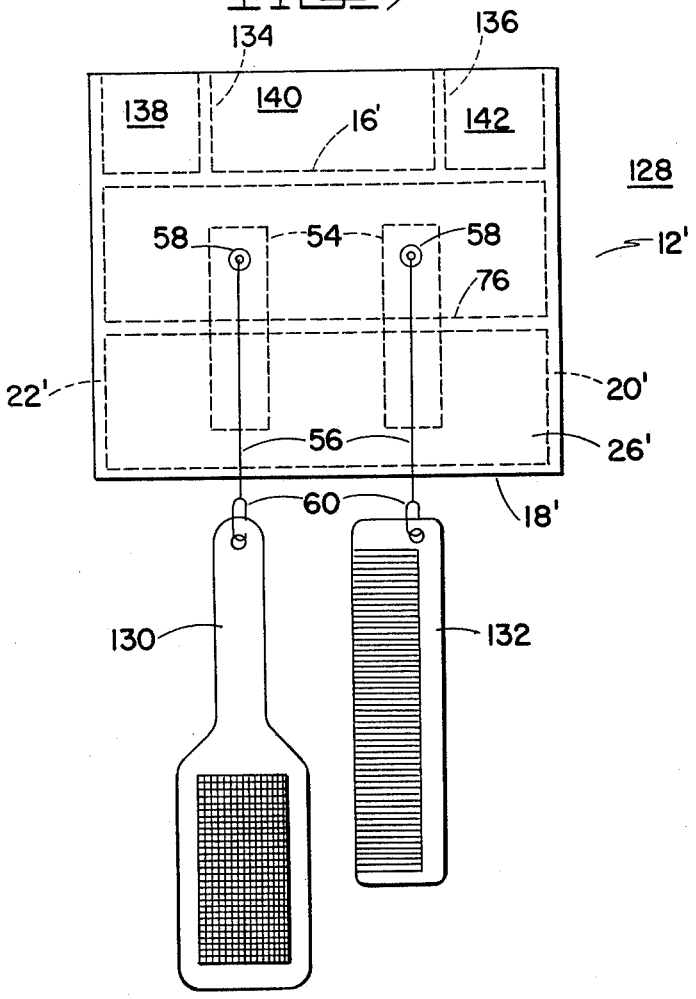
FIG. 7 is a front view showing another embodiment of the invention.
Figure 8:
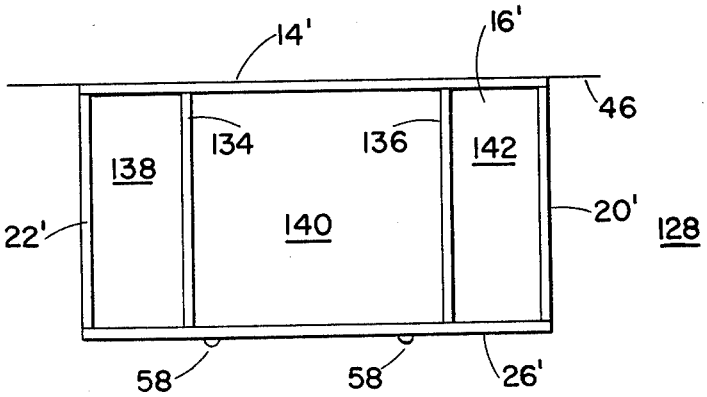
FIG. 8 is a top view of the embodiment of FIG. 7.

Referring now to FIGS. 7 and 8 in which like elements are again indicated by like reference numerals and similar elements by primed reference numerals, another embodiment of the invention is shown, generally indicated at 128, adapted particularly for retaining other types of toilet articles, such as brush 130 and comb 132. Here, housing 12' has top and bottom walls 16', 18', side walls 20', 22', and removable front wall 26'. Here, two reel devices 54 are shown (FIG. 7) mounted on common shaft 74 and having cords 56 respectively extending through grommets 58 respectively seated in openings in front wall 26'. Cords 56 are attached to brush 130 in comb 132 by clips 60.

Here, upward extensions of side walls 28', 22', back wall 14' and front wall 26' above top wall 16', together with partitions 134, 136 form compartments 138, 140, 142 for receiving other toilet items, such as hairpins, etc.

While there have been described above the principles of this invention in connection with specific apparatus, it is to be clearly understood that this description is made only by way of example and not as a limitation to the scope of the invention.

What is claimed is:

1. In a retainer for toilet articles or the like including a housing having front, back and side walls mutually defining a cavity, said back housing wall being adapted for mounting on a vertical building wall, the improvement wherein said front wall has at least one aperture therein communicating with said cavity, and comprising at least one reel device mounted in said cavity and having an elongated flexible element wound thereon, said flexible element extending outwardly through said front wall aperture and having means thereof for securing a toilet article thereto, said reel being adapted to pay-out said flexible element and including power drive means for reeling-in the same, whereby said flexible element may be payed-out responsive to application of manual withdrawing force on said toilet article to permit use thereof, and thereafter reeled-in to suspend said article from said housing front wall in a storage position.

2. The retainer of claim 1 wherein said reel device includes a stationary horizontal shaft mounted on and extending between opposite housing side walls, and a reel rotatably mounted on said shaft.

3. The retainer of claim 1 or claim 2 wherein there are at least two horizontally spaced apertures in said housing front wall, and at least two reel devices each having an elongated flexible element thereon extending outwardly through a respective front wall aperture.

4. The retainer of claim 1 wherein said reeling-in means includes spring means, ratchet means for permitting said paying-out while manually restraining said reeling-in whereby said elongated element is retained in a payed-out condition during use of said article, and means for selectively releasing said ratchet means thereby permitting reeling-in of said elongated element.

5. The retainer of claim 4 wherein said releasing means is responsive to release of tension on said elongated element.

6. The retainer of claim 4 wherein said releasing means is manually actuated.

7. The retainer of claim 1 wherein said reel device is motor-driven.

8. The retainer of claim 7 wherein said reel device includes a stationary horizontal shaft mounted on and extending between opposite side walls, and a reel rotatably mounted on said shaft, said motor including a first field member secured to said shaft, and a second field member secured to said reel and concentrically surrounding said first field member.

9. The retainer of claim 3 further comprising a second housing having back and side walls defining a second cavity, said first-named housing being positioned in said second cavity, and a cover member hingedly connected to a side wall of said second housing and closing said second cavity, said toilet article in said storage position being disposed in said second cavity.

10. The retainer of claim 9 wherein said back walls of said first and second housings are common, opposite vertically extending side walls of said first and second housings being common, the top and bottom side walls of said first housing being respectively spaced from the top and bottom side walls of said second housing respectively to define top and bottom compartments of said second cavity, at least one side wall of said second housing having vent means therein communicating with said second compartment.

11. The retainer of claim 10 further comprising a stationary horizontal shaft mounted on and extending between said vertically extending side walls of said first housing, there being at least two horizontally spaced apertures in said first housing front wall and at least two reel devices on said shaft each having an elongated flexible element thereon extending outwardly through a respective aperture.

* * * * *

UNITED STATES PATENT AND TRADEMARK OFFICE

CERTIFICATE OF CORRECTION

PATENT NO. : 4,248,254

DATED : February 3, 1981

INVENTOR(S) : Ronald L. Trimble

It is certified that error appears in the above-identified patent and that said Letters Patent are hereby corrected as shown below:

Col. 2, line 27, "connected" should be ---connection---

Claim 1, Col. 4, Line 33 "thereof" should be ---thereon---

Claim 1, Col. 4, Line 34 after "reel" insert ---device---

Signed and Sealed this

*Twelfth* Day of *May 1981*

[SEAL]

*Attest:*

RENE D. TEGTMEYER

*Attesting Officer*

*Acting Commissioner of Patents and Trademarks*